United States Patent [19]

Gomez

[11] 4,083,510

[45] Apr. 11, 1978

[54] SELF-ADJUSTING FAIRLEAD FOR SPRING REWOUND TAGLINE DEVICE

[75] Inventor: Secundino G. Gomez, Los Angeles, Calif.

[73] Assignee: McCaffrey-Ruddock Tagline Corporation, Los Angeles, Calif.

[21] Appl. No.: 695,638

[22] Filed: Jun. 14, 1976

[51] Int. Cl.[2] ..... B65H 75/48

[52] U.S. Cl. ..... 242/107; 242/157 R; 254/190 R

[58] Field of Search ..... 242/107–107.7, 242/157 R, 157.1; 254/190; 43/24

[56] References Cited

U.S. PATENT DOCUMENTS

| | | | |
|---|---|---|---|
| 2,413,786 | 1/1947 | Ruddock | 254/190 |
| 2,530,114 | 11/1950 | Bugg et al. | 242/107 |
| 2,532,828 | 12/1950 | Westfall | 242/107 |
| 3,048,369 | 8/1962 | Hanson | 242/157 R X |
| 3,176,931 | 4/1965 | Hannay | 242/157 R X |
| 3,263,941 | 8/1966 | Becker | 242/107 |

FOREIGN PATENT DOCUMENTS

| | | | |
|---|---|---|---|
| 600,526 | 6/1960 | Canada | 242/107 |

*Primary Examiner*—Harvey C. Hornsby
*Assistant Examiner*—John M. Jillions
*Attorney, Agent, or Firm*—Paul A. Weilein

[57] ABSTRACT

A spring rewound tagline device in which a cable reel has a fairlead with a cable guide means for guiding a cable to and from the cable reel as the cable is payed out and retrieved. The fairlead according to the present invention is self-adjusting and includes a support arm on which the cable guide means is pivoted for rotation, and the support arm is mounted on the tagline device for pivotal swinging movement, so that the support arm and the cable guide means are free to adjustably change their operative positions in response to the changes in the lead-off angle of the tagline or other cable, whereby to minimize acute cable bends and undesirable binding in the cable guide means.

2 Claims, 6 Drawing Figures

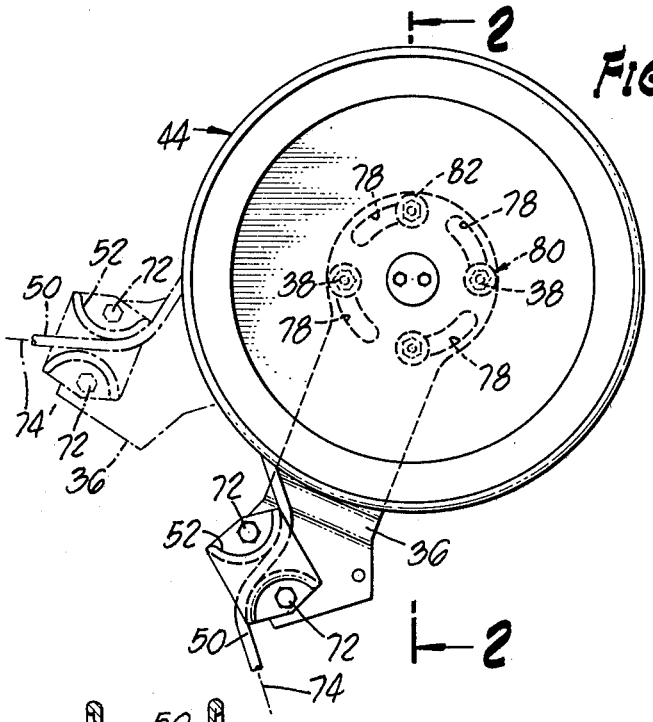
FIG. 1.
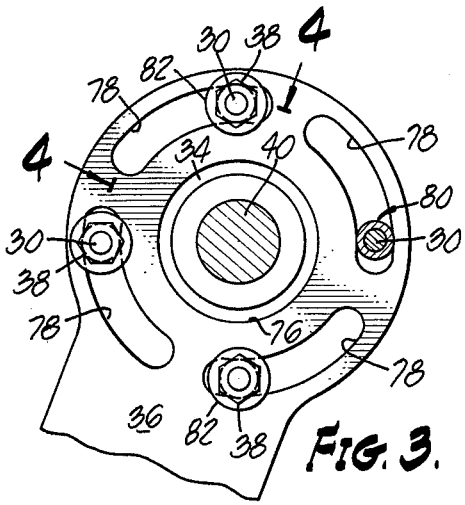
FIG. 3.
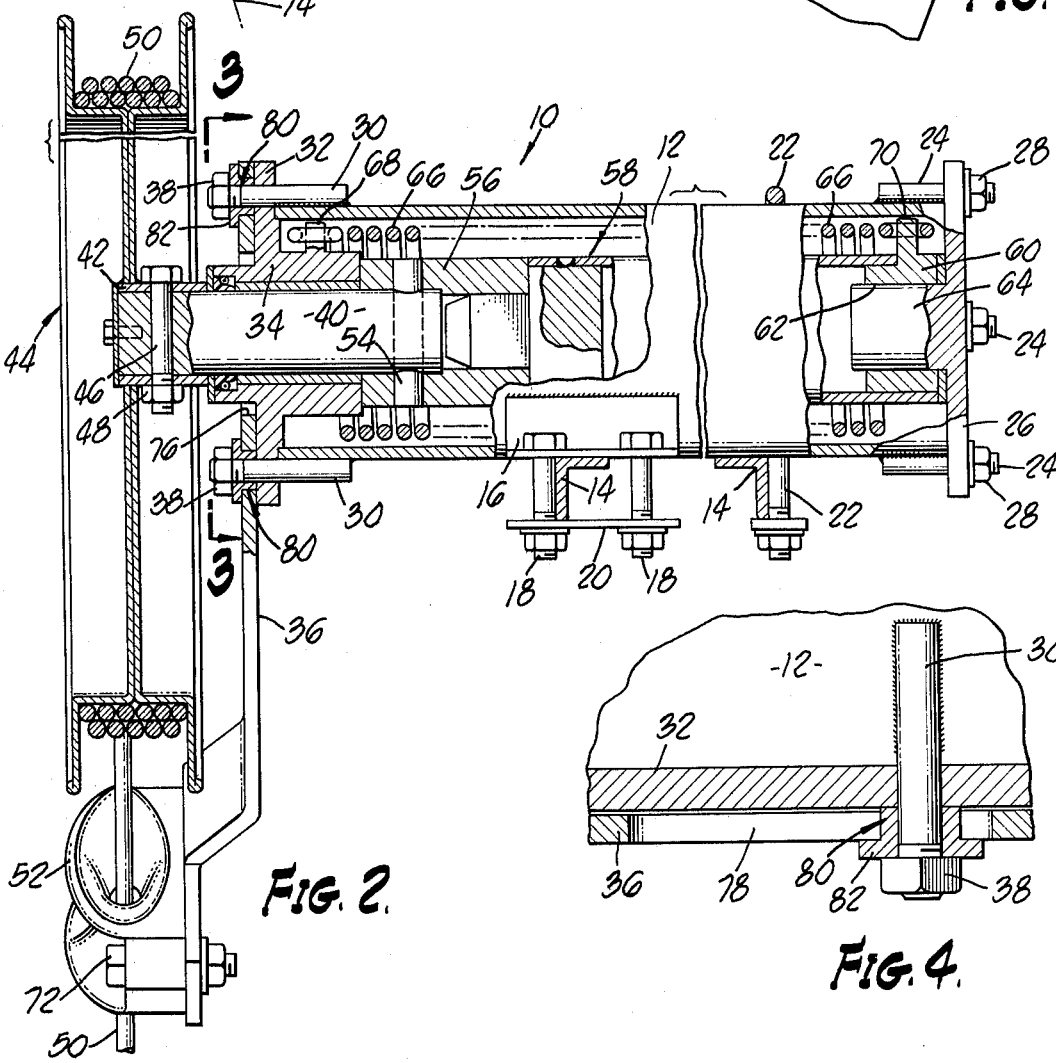
FIG. 2.
FIG. 4.

SELF-ADJUSTING FAIRLEAD FOR SPRING REWOUND TAGLINE DEVICE

BACKGROUND OF THE INVENTION

The present invention relates generally to the field of tagline devices.

Tagline devices of the type involved herein are conventionally employed on cranes to maintain tension on a tagline cable connected with a material handling device, such as a bucket, which is operated by the crane, to prevent erratic movements of the material handling device as it is raised and lowered. Basically, these tagline devices usually include a rotatably supported reel about which the tagline cable is wound, a fixed fairlead being provided which is intended to smoothly guide the cable to and from the reel as the cable is being payed out and retrieved during changes in the position of the material handling device to which it is connected. A problem arises in these known arrangements, in that the optimum orientation of the fairlead cable guide means varies with the usual swing of the material handling device during operation of the crane. Thus, as the lead-off angle of the cable passing through the cable guide means varies, due to the swing of the material handling device, the cable at some angular positions has a tendency to bind unduly in the cable guide means, and ceases to travel smoothly therethrough.

The self-adjusting fairlead of the present invention is designed to overcome and substantially eliminate the above noted problem.

SUMMARY OF THE INVENTION

The present invention relates generally to a tagline device having a spring rewound cable reel for paying out and retrieving a cable, and is more particularly concerned with a unique self-adjusting fairlead which will vary its operating position in response to changes in the lead-off angle of the tagline cable, so that the tagline cable will pass smoothly through a guide means of the fairlead.

Having in mind the inherent problem with respect to the fixed fairlead arrangement of the prior art tagline devices, it is an object of the present invention to provide a self-adjusting fairlead which will keep the cable guide means thereof in an oriented position which will assure smooth travel of the cable through the cable guide means.

A further object of the present invention is to provide a self-adjusting fairlead having parts so related and operable as to reduce wear and possible failure of tagline and other cables commonly employed with tagline devices.

Another object is to provide a self-adjusting fairlead which includes a swingably mounted support arm having a cable guide means mounted thereon.

Still another object is to provide a fairlead according to the previous object, in which the cable guide means is pivotally mounted on the fairlead support arm.

These and other objects are achieved according to the present invention by providing in association with a spring rewound tagline device having a rotatable cable reel, a self-adjusting fairlead for guiding a tagline cable to and from the cable reel. In one form, the self-adjusting fairlead comprises a support arm; a cable guiding means mounted on the support arm for receiving a cable from the cable reel; means for attaching the support arm on the tagline device in such a manner as to permit pivotal movement on the support arm with respect to the reel, so that the support arm may change position and vary the orientation of the cable guide means as a function of the lead-off angle of the associated tagline, or other cable. In another form, the cable guiding means is pivotally mounted on the support arm so as to permit it to independently vary its orientation to a position for best accommodating the movement of the cable.

These and other objects and advantages of the invention will become apparent subsequently from the details of construction and operation of the invention as more fully described and claimed herein.

BRIEF DESCRIPTION OF THE DRAWINGS

Referring to the accompanying drawings, which are for illustrative purposes only:

FIG. 1 is an end elevational view of a tagline device provided with a self-adjusting fairlead according to the present invention;

FIG. 2 is an enlarged side elevational view of the tagline device, partly in longitudinal section, taken substantially on line 2—2 of FIG. 1;

FIG. 3 is a fragmentary, transverse sectional view, taken substantially on line 3—3 of FIG. 2;

FIG. 4 is a fragmentary, enlarged sectional view taken substantially on line 4—4 of FIG. 3, showing details of the connection of the support arm of the fairlead;

DESCRIPTION OF THE PREFERRED EMBODIMENTS

Figure 5:
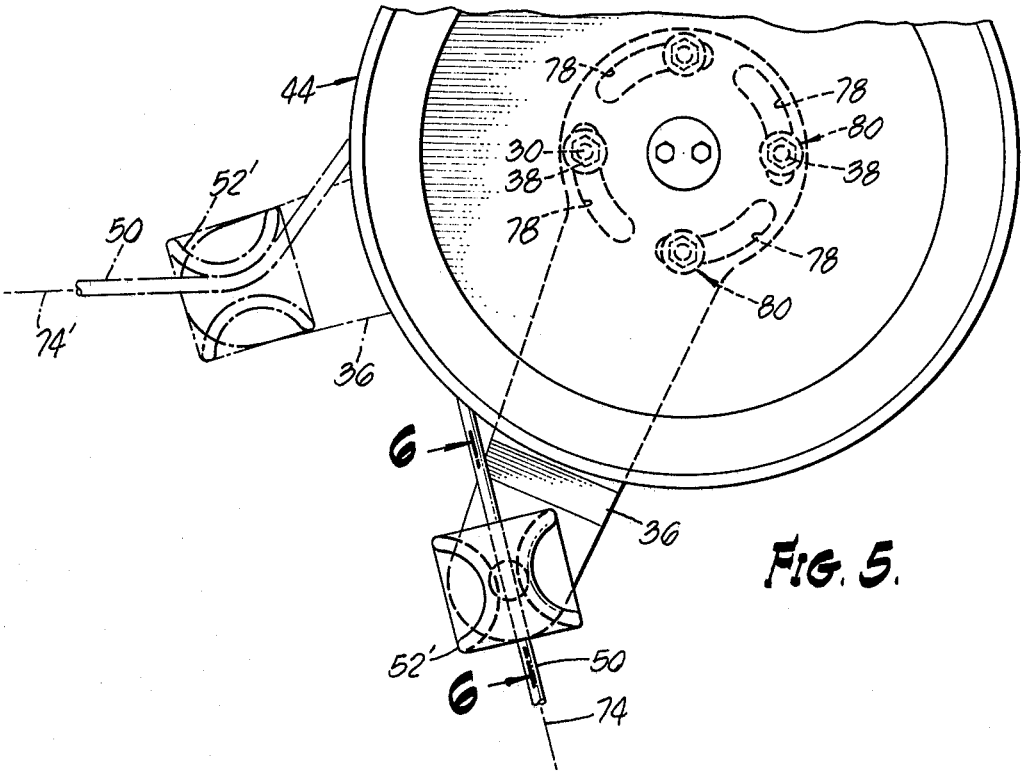
FIG. 5 is a view similar to FIG. 1, showing a modified arrangement in which the cable guide means is pivotally mounted on the support arm of the fairlead.

Referring more specifically to the drawings, for illustrative purposes, the invention is shown as being applied to a tagline device 10 having a hollow housing 12 which is connected to frame members 14 of a boom structure (not shown) as by means of a bracket or saddle 16 extending below one end of the housing and connected to the boom by means of bolts 18 and clamping plate 20. Adjacent the other end of the housing, it is secured as by a U-bolt 22. Any appropriate means, however, might be utilized for connecting the housing in an operative position to the boom structure.

The housing is provided at one end with a plurality of welded or otherwise secured projecting threaded stems 24 for the reception of an end plate or closure 26 which is secured in abutting contact with the adjacent end of the housing as by nuts 28 threaded on the stems. The opposite end of the housing is provided with a similar series of circumferentially spaced threaded stems 30 extending through a radially projecting flange 32 of a fixed bushing 34 and through one end of a fairlead supporting arm 36, as will hereinafter be described more fully, the flange 32 and associated end of the fairlead supporting arm 36 being secured in face engagement as by nuts 38 threaded onto the stems 30.

As best shown in FIG. 2, the tagline device further includes a shaft 40 which is rotatably supported in the fixed bearing 34, this shaft having its opposite ends projecting beyond the respective ends of the bearing. The outermost end of the shaft is secured to a hub 42 of a cable drum or reel 44 by appropriate means such as a through bolt 46 and threadedly engaged nut 48. The reel 44 has the tagline or other cable 50 wound thereon, a running end of this cable being carried through a bell cable guide 52 or other appropriate cable guiding means supported at the outermost end of the fairlead supporting arm 36.

The opposite end of the shaft 40 is secured as by a key 54 to a drive bushing 56 at one end of a cylindrical rotatable core structure, as generally indicted by the numeral 58, this core structure having its opposite end secured to a bearing sleeve 60 having a central bore 62 rotatably disposed upon a bearing post 64 which is shown as being integrally formed with the end closure 26.

A coiled torsion spring 66 is positioned in the annular space between the rotatable core structure 58 and the hollow housing 12, this spring having one end anchored to a projecting lug 68 formed on the fixed bearing 34, and its other end connected with a projecting lug 70 formed on the rotatable bearing sleeve 60. With this arrangement, it will be apparent that as the reel 44 is rotated in a direction to pay out the cable through the bell cable guide 52, the core structure 58 and the connected bearing sleeve 60 will be rotated in a direction to stress the torsion spring 66. Also, as the load on the cable is relieved, the torsion spring will act to retrieve the cable onto the reel 44.

The structure thus far described is more or less conventional and basically is embodied in a number of known tagline devices as exemplified by U.S. Pat. No. 3,062,479, issued Nov. 6, 1962 to H. V. Griffitts.

As previously mentioned, a problem arises in the known conventional tagline devices due to the fact that the fairlead supporting arm 36 and the bell cable guide 52 thereon are mounted in fixed positions. As a consequence, the fairlead and cable guide are unable to assure smooth travel of the cable at all times through the guide as the lead-off angle of the cable varies through a considerably wide angle between the upper raised and lowered positions of the material handling device during the crane operation. Thus, there exists the possibility of cable bind and excess wear at the extreme angular positions of operation. It is therefore a primary feature of the present invention to provide in one embodiment a swingable fairlead supportarm 36 with the bell cable guide 52 having a fixed orientation thereon. As will be seen in FIG. 1, the bell guide 52 is adapted to be mounted in alternate positions at the outer end of the support arm 36 to accommodate mounting of the tagline device for right and left operating installations. As illustrated in FIG. 1, the bell cable guide is secured by retaining bolts 72 in a proper position to smoothly guide the cable therethrough when its lead-off angle corresponds to the lowered load position of the material handling device, as shown in full lines and as indicated by the locus line 74, the supporting arm being self-adjusting to a position as shown in phantom lines as the lead-off angle is changed to correspond to that of the raised position of the material handling device as indicated by the locus line 74'.

As best shown in FIGS. 1 and 3, the fairlead supporting arm 36 is fabricated of plate material and at its innermost end is shaped to provide a generally circular end portion having a central opening 76 of a size which will permit this end to be placed in surrounding relationship to the outward projecting end of the fixed bearing 34 and in concentric relation to the shaft 40. Outwardly spaced from the opening 76, a plurality of arcuate slots 78 are circumferentially symmetrically spaced in concentric relation to the opening 76, each of these slots being adapted to receive the outermost end of a stem 30 therethrough. Each stem is guidingly supported in its associated slot by a circular bushing 80 having an overlapping outer end flange 82, this bushing being of an appropriate thickness such that when the nut 38 is tightened thereagainst, relative rotative movement of this end of the supporting arm 36 will be permitted. The slots 78 are of appropriate length to permit swinging movement of the supporting arm 36 between the full line and phantom line positions shown in FIG. 1.

Figure 6:
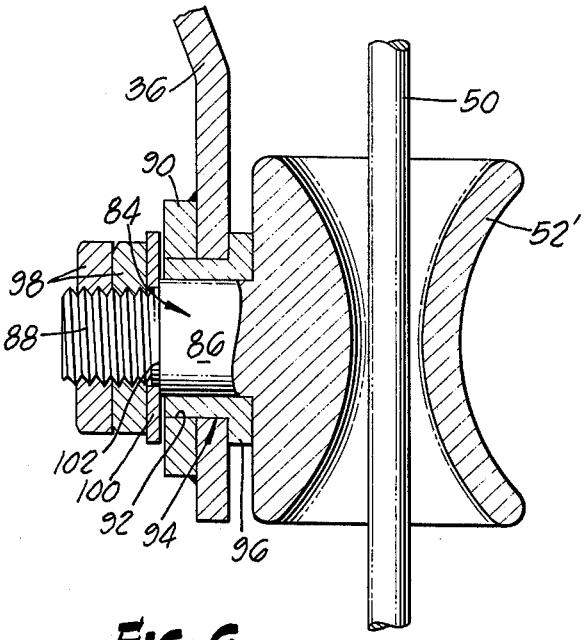
FIG. 6 is an enlarged sectional view taken substantially on line 6—6 of FIG. 5, to show details of the mounting for the cable guide means.

A modified form of the invention is shown in FIGS. 5 and 6, in which a bell cable guide 52' is arranged for pivotal mounting on the fairlead supporting arm 36. In this arrangement the bell guide is formed with a back pivot stud 84 having an inner cylindrical bearing surface 86 and a threaded projecting end portion 88. This end of the fairlead supporting arm 36 is made thicker by providing a welded plate 90. The thickened portion is provided with a circular bore 92 in which there is mounted a bearing bushing 94 for operatively receiving the bearing surface 86 of the pivot stud, this bushing having an inner end flange 96 which serves to space the body of the bell cable guide 52' away from the adjacent surface of the supporting arm 36. The bell cable guide is retained in mounted position by means of a pair of retaining nuts 98 which are arranged to be tightened against a washer 100, this washer abutting against a peripheral shoulder 102 which normally is positioned slightly outwardly of the outer face of the plate 90 so that the nuts 98 cannot be tightened to such an extent as to cause the pivot stud to be held against free rotation in the bushing 94. As thus arranged, it will be appreciated that the bell cable guide 52' is adapted to orient independently to an optimum position so that the movement of the cable therethrough will have less tendency to frictionally bind.

From the foregoing description and drawings, it will be clearly evident that the delineated objects and features of the invention will be accomplished.

Various modifications may suggest themselves to those skilled in the art without departing from the spirit of the disclosed invention, and hence, it is not wished to be restricted to the specific forms shown or uses mentioned, except to the extent indicated in the appended claims.

What is claimed is:

1. A spring rewound tagline device, comprising:

(a) an elongate housing structure;

(b) a cable reel at one end of said housing for paying out and retrieving a cable, said reel being supported on a shaft rotatably mounted in said housing and being connected to a rewind spring therein;

(c) means for guiding the cable in its movement to and from said reel;

(d) means for supporting said guiding means adjacent the reel periphery for automatic adjusting movements in response to changes in the lead-off angle of the cable at said guiding means comprising:

an elongate support arm mounting the guiding means at an outer end thereof, said arm having a flat inner end portion abutting said one end of said housing and having an opening loosely surrounding said shaft, a plurality of circumferentially spaced arcuate slots through said flat inner end portion surrounding said opening, a stud means on said housing extending through each of said slots for swingably mounting said inner end portion of the arm to said one end of said housing for limited pivotal movement of the support arm about the axis of said shaft; said stud means including a stud bushing movable in a slot, said bushing having a length greater than the thickness of the material containing said slot; and a radially projecting end flange portion in overlapping relation to the adjacent marginal surface of the associated slot to retain the arm inner end portion in sliding engagement with said one end of said housing.

2. A device according to claim 1, in which said guide means includes a bell guide mounted for rotation on an axis in right angled relation to the axis of the passage of said cable therethrough.

* * * * *